US009364970B2

(12) United States Patent
Chen

(10) Patent No.: US 9,364,970 B2
(45) Date of Patent: Jun. 14, 2016

(54) TABLE CUTTING MACHINE

(71) Applicant: CHERVON INTELLECTUAL PROPERTY LIMITED, Road Town (VG)

(72) Inventor: Zhifeng Chen, Nanjing (CN)

(73) Assignee: CHEVRON (HK) LIMITED, Wanchai (HK)

( * ) Notice: Subject to any disclaimer, the term of this patent is extended or adjusted under 35 U.S.C. 154(b) by 142 days.

(21) Appl. No.: 14/447,757

(22) Filed: Jul. 31, 2014

(65) Prior Publication Data

US 2015/0033925 A1 Feb. 5, 2015

(30) Foreign Application Priority Data

Aug. 2, 2013 (CN) ..... 2013 1 0335182

(51) Int. Cl.
*B28D 7/02* (2006.01)
*B28D 7/00* (2006.01)

(52) U.S. Cl.
CPC .. *B28D 7/02* (2013.01); *B28D 7/00* (2013.01); *Y10T 83/263* (2015.04)

(58) Field of Classification Search
CPC ..... B28D 7/02; B28D 7/00; Y10T 83/263
USPC ..... 83/168, 169, 170, 171
See application file for complete search history.

(56) References Cited

U.S. PATENT DOCUMENTS 3,123,951 A * 3/1964 Kuris ..... B08B 3/12 125/11.01
3,808,887 A * 5/1974 Buttriss ..... G01F 23/2922 116/DIG. 5
3,816,875 A * 6/1974 Duncan ..... B26D 1/15 452/149
4,129,038 A * 12/1978 Leutenegger ..... B67D 7/367 116/4
4,428,159 A * 1/1984 Sigetich ..... B28D 1/047 125/13.03
4,484,417 A * 11/1984 Klingerman ..... B23D 59/02 125/13.01
4,571,998 A * 2/1986 Stegner ..... G01F 23/44 340/624
4,976,251 A * 12/1990 Smith ..... B23D 47/025 125/13.01
4,994,682 A * 2/1991 Woodside ..... G01F 23/2925 250/577
7,258,052 B1 * 8/2007 McLean ..... B26D 7/088 83/168
2002/0027023 A1 * 3/2002 Britz ..... B23Q 11/005 175/210
2002/0148651 A1 * 10/2002 DeBlasio ..... B28D 7/02 175/65
2002/0162513 A1 * 11/2002 Winney ..... B23D 59/02 119/78
2003/0213482 A1 * 11/2003 Buser ..... B23Q 11/0046 125/12
2008/0289467 A1 * 11/2008 Skillings ..... B23D 45/068 83/169
2009/0235792 A1 * 9/2009 Tsung ..... B23D 59/02 83/169
2009/0255390 A1 * 10/2009 Chaffin ..... A22C 17/0006 83/168
2014/0216224 A1 * 8/2014 Bernhardt ..... B28D 1/04 83/102.1
2015/0287313 A1 * 10/2015 Silvers ..... G01F 23/0015 340/618
2015/0298354 A1 * 10/2015 Greitmann ..... B28D 1/04 83/169
2015/0298355 A1 * 10/2015 Ohlendorf ..... B28D 1/04 83/169
2015/0367530 A1 * 12/2015 Vikholm ..... B28D 7/02 125/13.01

* cited by examiner

*Primary Examiner* — Sean Michalski
(74) *Attorney, Agent, or Firm* — Greenberg Traurig, LLP

(57) ABSTRACT

A table cutting machine includes a table for carrying an object to be cut; a cutting device, associated with the table, for cutting the object to be cut; a water tank for providing a cooling water to the cutting device; and a water level indicating device for indirectly indicating a water level of the cooling water from a top of the table or a side of the water tank. The device thus enables the user to observe the water level from the top of the table or the side of the water tank of the table cutting machine without removing the table during the observation.

20 Claims, 6 Drawing Sheets

TABLE CUTTING MACHINE

RELATED APPLICTION INFORMATION

This application claims the benefit of CN 201310335182.3, filed on Aug. 2, 2013, the disclosure of which is incorporated herein by reference in its entirety.

FIELD OF THE DISCLOSURE

The subject disclosure relates to a table cutting machine having a water tank.

BACKGROUND OF THE DISCLOSURE

A table cutting machine is a special cutting machine for cutting stone material, such as tile, and its main cutting tool is a circular saw blade. During the cutting process, the saw blade is driven by a motor to rotate at a high speed so as to cut an object to be cut.

During the specific cutting process, the saw blade may generate a lot of heat due to friction, and the work life of the saw blade may be reduced if the saw blade cannot be cooled duly.

Thus, the current table cutting machine generally has a water tank, and the saw blade may protrude into the cooling water in the water tank through a slot or an opening formed in the table.

The current table cutting machine does not have a device for observing the water level in the water tank or a device for alerting the water level, thus the user only observes and judges the water level through the slot in the table. Now, there is no table cutting machine having a water level indicating device.

SUMMARY

In order to overcome the defects in the prior art, the following generally describes a table cutting machine which can observe the water level conveniently and send an alarm to the user about the water level.

More particularly, the following describes a table cutting machine, comprising: a table for positioning an object to be cut; a cutting device for cutting the object to be cut; a water tank for accommodating a cooling liquid; a water level indicating device for indirectly indicating a height of the liquid level of the cooling liquid in the water tank from the table; wherein the water tank has a water storing space with a top opening, and the table is mounted above the water tank and covers the opening of the water tank.

Furthermore, the water level indicating device may comprise a buoyancy ball and an indicating assembly; wherein the indicating assembly may comprise: a connecting rod pivotally connected to the water tank about a first axis; a water level ruler mounted to the table; a vernier slidably connected to the water level ruler along a second axis; a flexible member for connecting the connecting rod with the vernier; a driving member for driving the vernier to always move towards a position indicating the lowest water level; and an idler wheel for guiding the flexible member; wherein the buoyancy ball is arranged on one end of the connecting rod, and the other end of the connecting rod is connected to one end of the flexible member, and the other end of the flexible member is connected to one end of the vernier.

Furthermore, the water level indicating device may comprise a buoyancy ball and an indicating assembly; wherein the indicating assembly comprises a buoyancy connecting rod pivotally connected to the water tank about a third axis and with one end fixedly connected to the buoyancy ball; a transmission connecting rod pivotally connected to the other end of the buoyancy connecting rod about a fourth axis; a displaying window fixed in a through hole formed in the table; and a rotating assembly for displaying the water level in the displaying window by its rotation.

Furthermore, the water level indicating device may comprise a buoy and an indicating assembly, wherein the indicating assembly comprises a transparent indicating box fixed to one side of the water tank and having an accommodating space communicated with the water storing space in the interior of the water tank, and the buoy is accommodated in the accommodating space of the indicating box.

As will be understood, the described device provides an advantage in that the user is enabled to observe the water level of the cooling water from the top of the table or the side of the water tank of the table cutting machine without removing the table during the observation. Moreover, the condition of the water level can be reflected duly and effectively, thereby preventing the failure caused by lacking water.

DETAILED DESCRIPTION

The present invention will be described in detail with reference to the drawings embodiments.

As shown in FIGS. 1-4, an exemplary table cutting machine 10 comprises a table 14 for positioning an object to be cut, a cutting device 13 for cutting the object to be cut on the table 14, and a water tank 12 for providing a cooling water to the cutting device 13.

Figure 1:
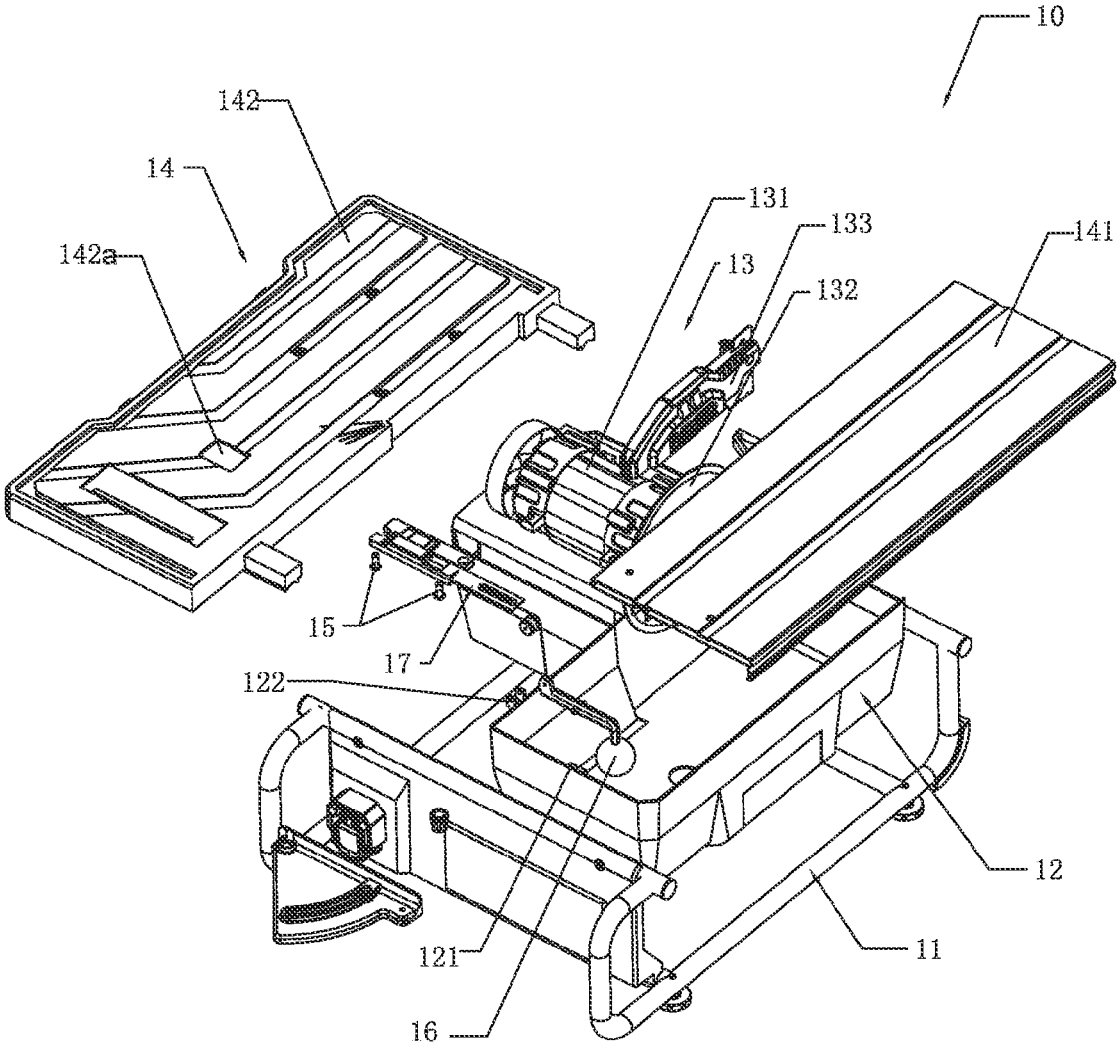
FIG. 1 is a schematic view of an exemplary table cutting machine constructed according to the description which follows.

The water tank 12 and the cutting device 13 are mounted on a supporting frame 11. The supporting frame 11 is mainly used to provide a support so as to enable the whole table cutting machine to be supported on a relative flat surface. The main positioning plane of the table 14 should be parallel to a horizontal plane. As shown in FIG. 1, the water tank 12 has a box structure with a top opening, and a water storing space is formed in the interior of the box structure.

The cutting device 13 is fixed above the supporting frame 11. Generally speaking, the cutting device 13 comprises a motor 131, a saw blade 132 and a shield 133. The motor 131 can drive the saw blade 13 to rotate to perform a cutting, and the shield 133 is mainly used to provide a protection during the operation.

The table 14 is composed of two main portions, i.e., a first table 141 and a second table 142, arranged on two opposite sides of the saw blade 132 respectively. A lower edge portion of the saw blade 132 can protrude into the water storing space of the water tank 12 through a gap between the first table 141 and the second table 142. When sufficient water is accommodated in the water tank 12, the saw blade 32 can contact the water to achieve a cooling.

As a preferred solution, the first table 141 covers the top side of the water tank 12 and closes the opening. The connection formed by the first table 141 and the water tank 12 may be easily removed so as to fill water into the water tank 12 after the connection is removed. In contrast, the second table 142 is mainly used to cover the motor 131 and the corresponding transmission portions.

The table cutting machine 10 further comprises a water level indicating device for indicating the water level of the cooling water in the water tank 12 from a top of the table 14 and a side of the water tank 12.

Specifically speaking, the water level indicating device comprises a buoy 16 for detecting the water level via its buoyancy and an indicating assembly 17 for indicating the water level by the position of the buoy 16. The buoy 16 is a member for reflecting the position of the liquid surface by buoyancy principle, and the indicating assembly 17 indirectly indicates the water level of the cooling water in the water tank 12 by the display of the position of the buoy 16. The buoy 16 is arranged in the interior of the water tank 12, and the indicating assembly 17 is mainly used to constitute an indicating interface for providing a prompt to the user at the top of the table 14 or the side of the water tank 12, because these two positions are most easy to observe when the user operates the table cutting machine 10.

As shown in FIGS. 1-4, the buoy 16 may be a buoyancy ball 161. The buoyancy ball 161 may be formed by a plastic material having a density smaller than water or formed by a metal material with a hollow structure.

In the figures, the indicating assembly comprises a connecting rod 21, a water level ruler 22, a vernier plate 23, a flexible member 24, a spiral spring 25 and an idler wheel 26.

Figure 2:
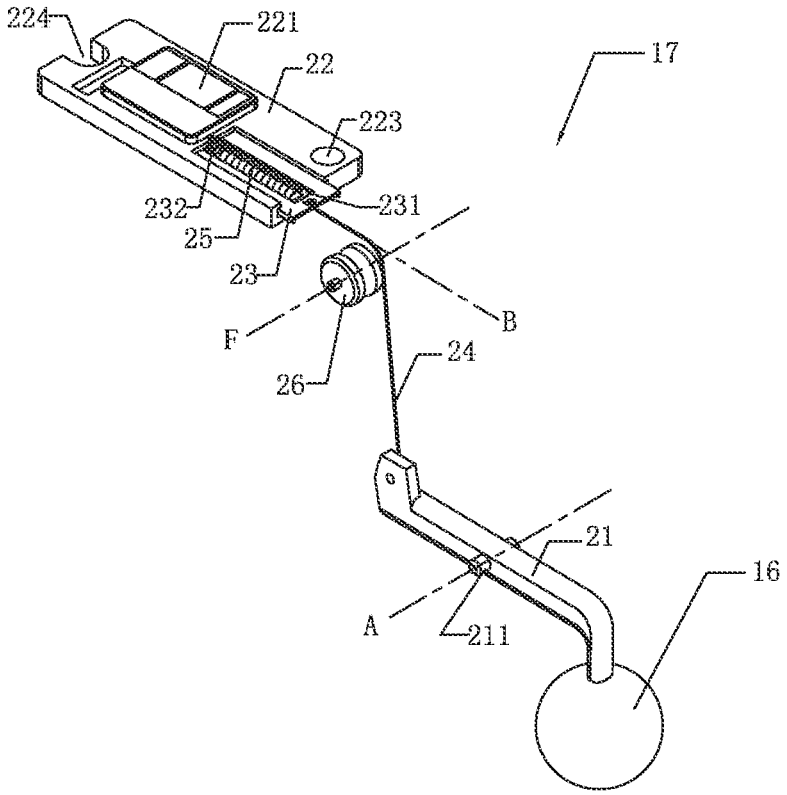
FIG. 2 is a schematic view of an exemplary water level indicating device usable with the machine shown in FIG. 1.

One end of the connecting rod 21 is fixedly connected to the buoyancy ball 161, and the other end is fixedly connected to the flexible member 24. The connecting rod 21 and the water tank 12 form a pivoting connection about a first axis A. Specifically, the connecting rod 21 has a rotating shaft 211 for forming the pivoting connection. The rotating shaft 211 may be integrally formed with the other parts of the connecting rod 21, as shown in FIG. 2, or may be formed by a rotating shaft member independent from the connecting rod 21. The water tank 21 has a supporting base 121. The supporting base 121 is provided with a groove for accommodating the connecting rod 21 and a shaft hole formed in the wall of the groove and mated with the rotating shaft 211. It should be noted that in order to ensure a sufficient space for the buoyancy ball 161 to float upwards and downwards, the supporting base 121 should have sufficient height and the portion of the connecting rod 21 at the side for fixing the buoyancy ball 161 should have sufficient length.

The other end of the flexible member 24 is fixedly connected to one end of the vernier plate 23. Preferably, the flexible member 24 may pass through the through holes formed in the vernier plate 23 and the connecting rod 21 respectively and then achieve a connection by connecting means such as knotting and welding. The flexible member 24 is mainly used to perform a transmission. In order to tighten and guide the flexible member 24, the idler wheel 26 is provided in this embodiment. A wheel shaft axis F of the idler wheel 26 is parallel to the first axis A, and cooperates with a shaft bracket 122 formed by the top end of the wall of the water tank 12 through its wheel shaft so as to be pivotally connected to the water tank 12. Certainly, if the structure of the water tank 12 is complicated and the flexible member 24 needs to be guided many times, there may be more than one idler wheel 26, and the direction of each idler wheel may be set according to the actual requirements, which are not limited to the present embodiment.

The water level ruler 22 is provided with an inserting groove 225, and the vernier plate 23 is inserted to the inserting groove 225 and thus forms a sliding connection with the inserting groove 225 along a second axis B. The water level ruler 22 is mainly used to be fixedly connected to the first table 14, and provide a visible interface for indicating the water level, and indicate the moving position of the vernier plate 23 through its own scales so that the user can obtain the specific position of the water level. In order to be fixedly connected to the first table 142, the water level ruler 22 is provided with a through hole 223 and an indentation groove 224 at two ends respectively. The water level ruler 22 may be fixedly connected to the first table 142 from the bottom side through two fastening bolts 15 mating with the through hole 223 and the indentation groove 224 respectively. In order to observe the condition of the water level ruler 22, the first table 142 is provided with a table through hole 142*a* at the installing position of the water level ruler 22 on the first table 142, in order to reveal the portion of the water level ruler 22 for displaying.

As a preferred solution, both the first axis A and the second axis B are parallel to the horizontal plane, and the first axis A is perpendicular to the second axis B. The first axis A and the second axis B are parallel to the horizontal plane means that in the normal use condition, the direction of the rotating shaft of the connection rod 21 and the water tank 12 and the direction in which the vernier plate is slidably connected to the water level ruler are parallel to the horizontal plane, but as for the relative relation therebetween, the first axis A is perpendicular to the second axis B.

The water level ruler 22 has an observing window 221 at the top thereof, and one end of the vernier plate 23 which is not connected to the flexible member 24 is inserted into the bottom of the observing window 221. The observing window 221 covers one end of the sliding stroke of the vernier plate 23. The observing window 221 is at least provided with a transparent portion in the sliding direction of the vernier plate 23. As such, the user can judge the real time condition of the water level by observing the sliding condition of the vernier plate 23. As a further solution, the observing window 221 is provided with scales for indicating the water level, and the vernier plate 23 is provided with indicating arrows correspondingly.

As a preferred solution, the observing window 221 may project beyond the peripheral portions and then be inserted into the table through hole 142*a*, thereby having a larger visible angle and facilitating the observation of the user.

As shown in FIGS. 1-2, when sufficient water is filled in the water tank 12, the buoyancy ball 161 floats in the liquid surface under the action of buoyancy. Then, the end of the connecting rod 21 connected to the buoyancy ball 161 rises, and the other end connected to the flexible member 24 descends. At that moment, the vernier plate 23 is pulled to move away from the water level ruler 22. Contrarily, when the liquid surface descends, the buoyancy ball 161 descends with the liquid surface accordingly. It should be noted that when the liquid surface descends to a relative low position, it cannot be ensured that the vernier plate 23 can move to a position for accurately indicating the liquid surface if the vernier plate 23 is pulled by the buoyancy ball 161 only, because the supporting base 121 per se has a certain height.

Figure 3:
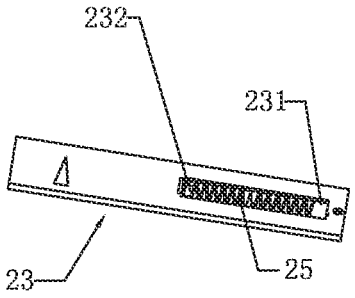
FIG. 3 is a schematic view of an exemplary vernier plate and spiral spring of the device shown in FIG. 2.
Figure 4:
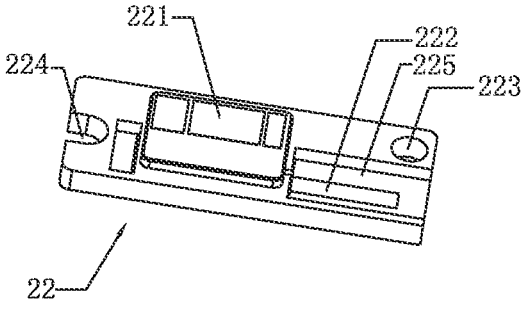
FIG. 4 is a schematic view of an exemplary water level ruler in the device in FIG. 2.

Referring to FIGS. 2-4, as a preferred solution, in order to solve the problem that the vernier plate 23 cannot accurately indicate the water level when the water level is relative low, the water level ruler 22 is provided with a first slotted hole 222, and the portion of the vernier plate 23 overlapping with the first slotted hole 222 is provided with a second slotted hole 231. The spiral spring 25 is arranged in the overlapping portion of the first slotted hole 222 and the second slotted hole 231. One end of the spiral spring 25 abuts against one end of the first slotted hole 222 adjacent to the buoyancy ball 161, and the other end abuts against one end of the second slotted hole 231 away from the buoyancy ball 161. As a further solution, the second slotted hole 231 is provided with a positioning post 232 for fixing the spiral spring 25. The positioning post 232 can fix the end of the spiral spring 25 better and more reliably so that the spiral spring 25 cannot be removed easily. Certainly, other common embodiments for fixing the spiral spring 25 may also be used herein.

Figure 5:
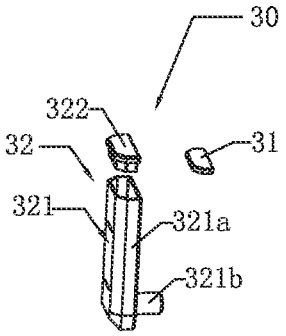
FIG. 5 is a schematic view of an exemplary water level indicating device usable with the machine shown in FIG. 1.

As shown in FIG. 5, the water level indicating device can be used to facilitate the observation of the user from the side of the machine.

The buoy in the water level indicating device 30 is an indicating buoy 31 which can float in the water surface. As a preferred solution, the indicating buoy 31 has bright color for facilitating the observation, and also has a certain shape size for facilitating the observation. The indicating assembly in the water level indicating device comprises a transparent indicating box 32, and a hollow chamber is formed in the indicating box 32 and communicated with the water storing space in the interior of the water tank. The indicating box 32 is fixed on the side of the water tank.

Specifically, the indicating box 32 comprises a box body 321 having a top opening and a box cover 322 for closing the opening of the box body 321. The box cover 322 is mounted at the opening of the box body 321, and the box body 321 comprises an indicating portion 321*a* for observation from the side of the water tank and a communicating portion 321*b* for passing through the wall of the water tank. The indicating portion 321 a should have a certain size in the height direction of the water tank, and may be provided with scales for indicating the water level.

As a preferred solution, the shape of the cross section of the indicating buoy 31 is similar to and slightly smaller than that of the indicating portion 321*a* of the box body 321. In order to better arrange the indicating box 32, a groove may be formed in the side of the water tank, and the indicating box 32 may mounted in the groove. It should be noted that the communicating portion 321*b* actually passes through the side of the water tank. In order to prevent water leakage, a sealing member such as sealing ring may be arranged at the jointing position of the communicating portion 321*b* and the side wall of the water tank correspondingly.

As an improvement of the solution in FIG. 5, the indicating box 32 is not provided with the buoy 31, since the user can observe the water level of the cooling water through the indicating box even if the indicating box 32 is not provided with the buoy 31.

It can be seen from the above description that the solution shown in FIG. 5 is relatively simple to achieve, because it is mounted to the side of the water tank, which is the main portion capable of directly reflecting the height direction. But, the top of the table may be the best observation position for the user.

Thus, as a further preferred solution, the table cutting machine may comprise two water level indicating devices as shown in FIG. 1 and FIG. 5 respectively, thereby comprehensively indicating the water level.

Referring to FIGS. 6-9, the buoyancy body may also be a buoyancy ball 43, and the specific indicating assembly in the water level indicating device 41 may comprise a buoyancy connecting rod 411, a transmission connecting rod 412, a displaying window 413 and a rotating assembly 414.

The buoyancy connecting rod 411 has one end fixedly connected to the buoyancy ball 43, and is pivotally connected to the water tank 42 about a third axis C. The specific form may be seen from the example shown in FIG. 1, and the difference is that the other end of the buoyancy connecting rod 411 is pivotally connected to one end of the transmission connecting rod 412 about a fourth straight line D which is parallel to the third axis C. The transmission connecting rod 412 is mainly used to achieve a transmission, and transmits the movement of the buoyancy connecting rod 411 to the rotating assembly 414, thus the other end of the transmission connecting rod 412 should contact the rotating assembly 414.

The rotating assembly 414 comprises an indicating member 414*a*, a mounting post 414*b* and a transmission cam 414*c*. The indicating member 414*a* is pivotally connected to the wall of the water tank 42 about a fifth straight line E. Specifically, the indicating member 414*a* is pivotally connected to the water tank 42 through a mounting structure 422 formed on the wall of the water tank 42. The mounting structure 422 is formed on the top of the wall of the water tank 42.

The third axis C, the fourth straight line D and the fifth straight line E are all parallel to the horizontal plane, wherein the third axis C is parallel to the fourth straight line D, and the fifth straight line E is perpendicular to the third axis C, thus the fifth straight line E should be perpendicular to the fourth straight line D.

The mounting post 414*b* is fixedly connected to the indicating member 414*a* by one end thereof, and the other end is fixedly connected to the transmission cam 414*c*. Further, the axis of the mounting post 414*b* is far from the rotating axis of the indicating member 414*a*, thus the indicating member 414*a* may swing accordingly when the transmission connecting rod 412 drives the mounting post 414*b*.

As a preferred solution, the indicating member 414*a* has an arc or a cone frustum side, and a mark is arranged on the side, thus the indicating member 414*a* can indicate the water lever by means of the mark when swinging.

Figure 9:
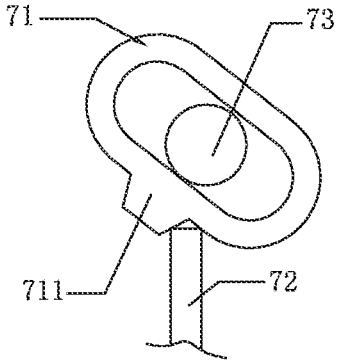
FIG. 9 is a schematic view of an exemplary connection between a transmission cam and a transmission connecting rod in the device shown in FIG. 6.

During the rotation of the indicating member 414*a*, the position of the mounting post 414*b* is changed. In order to make the top end of the transmission connecting rod 412 always drive the mounting post 414*b*, as shown in FIG. 9, the transmission cam 71 has a transmission projection 711. The transmission projection 711 enables the top end of the transmission connecting rod 72 to effectively support the mounting post 73 through the transmission projection 711 even if the position of the mounting post 73 has been changed due to the rotation of the indicating member. It is also contemplated that the shape contour line of the transmission cam 71 can comprise two symmetrical semicircular edges and a straight line edge and a projecting edge for connecting the two symmetrical semicircular edges. The projecting edge comprises three adjacent straight lines which form an isosceles trapezoid. The mounting post 73 can be mounted to the transmission cam 71 through a waist-shaped hole formed in the transmission cam 71.

Figure 7:
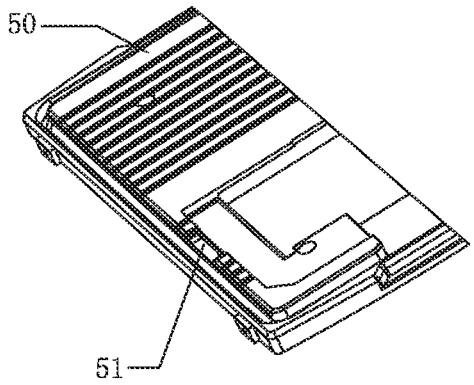
FIG. 7 is a partial schematic view of an exemplary table for use with the water level indicating device as shown in FIG. 6.
Figure 8:
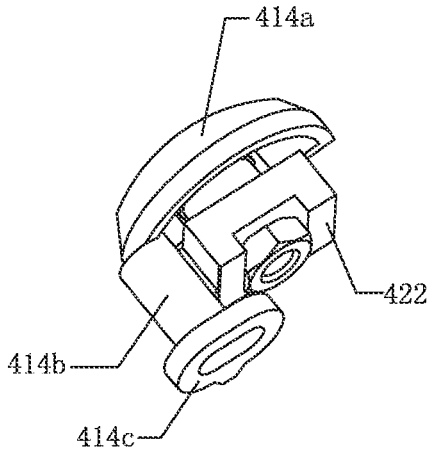
FIG. 8 is a schematic view of an exemplary rotating assembly of the device shown in FIG. 6.

As shown in FIG. 7, the table 50 can be provided with a through hole 51 for mounting the displaying window. The user can observe the displaying window from the top of the table 50 and obtain the specific condition of the water level.

Figure 6:
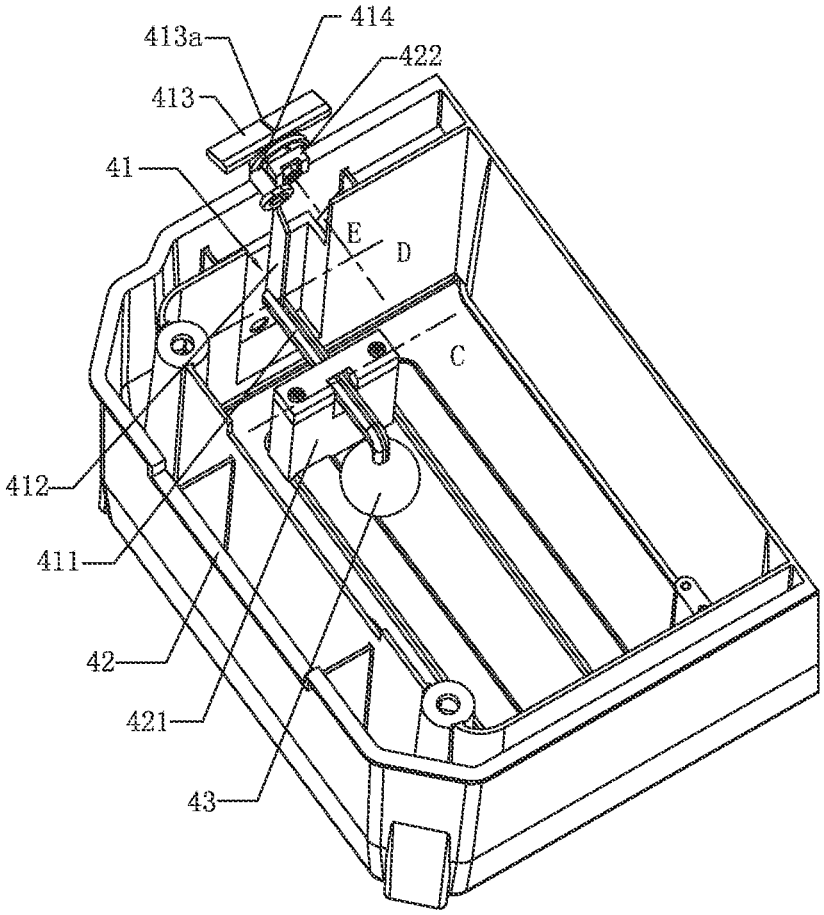
FIG. 6 is a schematic view of an exemplary water level indicating device and water tank usable with the machine shown in FIG. 1.

As shown in FIG. 6, the displaying window 413 can be provided with an indicating mark 413*a*.

Further, in order to overcome the problem of a relative low water level when the user ignores the water level indicating device without observing carefully, as a preferred solution and based on the above contents, the table cutting machine may further comprise an electrical alarming device which may be triggered by the buoy at an alerting position to send an alarm. Specifically speaking, the electrical alarming device comprises a detecting device which may be triggered by the buoy and an alarming device for sending an alarm. The detecting device may be a contact switch, and the alarming device is a LED light, speaker, or the like which is electrically connected to the contact switch.

In a specific configuration, the contact switch may be arranged at other positions for detecting the position of the buoy or other structures coupled with the buoy. Once they move to the position representative of the alerting water level, the contact switch is triggered to control the LED light to flicker, thereby sending an alarm to the user.

Certainly, the detecting device may be other detecting elements, and the alarming device may also be other devices such as a buzzer.

The above illustrates and describes basic principles, main features and advantages of the present invention. Those skilled in the art should appreciate that the above embodiments do not limit the present invention in any form. Technical solutions obtained by equivalent substitution or equivalent variations all fall within the scope of the present invention.

What is claimed is:

1. A table cutting machine, comprising:

a table for carrying an object to be cut;

a cutting device associated with the table for cutting the object to be cut;

a water tank for accommodating a cooling liquid to be contacted by at least a portion of the cutting device; and a water level indicating device for indirectly indicating a height of a liquid surface of the cooling liquid in the water tank from the table;

wherein the water tank comprises a water storing space with a top opening, and the table is mounted above the water tank and covers the opening of the water tank.

2. The table cutting machine according to claim 1, wherein the water level indicating device comprises a buoyancy ball and an indicating assembly wherein the indicating assembly comprises:

a connecting rod pivotally connected to the water tank about a first axis;

a water level ruler mounted to the table;

a vernier slidably connected to the water level ruler along a second axis;

a flexible member for connecting the connecting rod with the vernier;

a driving member for driving the vernier to always move close to a position indicating the lowest water level; and an idler wheel for guiding the flexible member;

wherein the buoyancy ball is arranged on one end of the connecting rod, and the other end of the connecting rod is connected to one end of the flexible member, and the other end of the flexible member is connected to one end of the vernier.

3. The table cutting machine according to claim 2, wherein the first axis is perpendicular to the second axis, and a wheel shaft of the idler wheel is parallel to the first axis.

4. The table cutting machine according to claim 3, wherein the water level ruler comprises:

an inserting groove for accommodating the vernier to move therein; and an observing window for observing the position of the vernier in the inserting groove.

5. The table cutting machine according to claim 4, wherein the vernier is a vernier plate with one end connected to the flexible member and the other end inserted into the inserting groove.

6. The table cutting machine according to claim 5, wherein the water level ruler further comprises a first slotted hole and the vernier plate further comprises a second slotted hole overlapping with the first slotted hole.

7. The table cutting machine according to claim 6, wherein the driving member is a spiral spring with one end abutting against one side of the first slotted hole adjacent to the buoyancy ball and the other end abutting against one side of the second slotted hole away from the buoyancy ball.

8. The table cutting machine according to claim 7, wherein the second slotted hole is provided with a positioning post for fixing the spiral spring.

9. The table cutting machine according to claim 8, wherein the vernier plate is provided with indicating arrows, and the water level ruler is provided with scales for indicating the water level.

10. The table cutting machine according to claim 2, wherein the table cutting machine further comprises an electronic alarming device for sending an alarm to a user when the cooling liquid in the water tank rises beyond an alerting line.

11. The table cutting machine according to claim 10, wherein the electronic alarming device comprises a detecting device for detecting a position of the buoyancy ball and an alarming device for sending an alarm, wherein the detecting device comprises a contact switch and the alarming device is a LED light which is electrically connected to the contact switch.

12. The table cutting machine according to claim 1, wherein the water level indicating device comprises a buoyancy ball and an indicating assembly; and the indicating assembly comprises:

a buoyancy connecting rod pivotally connected to the water tank about a third axis and fixedly connected to the buoyancy ball at one end thereof;

a transmission connecting rod pivotally connected to the other end of the buoyancy connecting rod about a fourth axis;

a displaying window fixed in a through hole formed in the table; and a rotating assembly for displaying a water level in the displaying window by its rotation.

13. The table cutting machine according to claim 12, wherein the rotating assembly comprises:

an indicating member pivotally connected to a wall of the water tank about a fifth straight line;

a mounting post with one end fixedly connected to the indicating member and an axis thereof away from the rotating axis of the indicating member; and a transmission cam mounted to the other end of the mounting post and used to contact a top end of the transmission connecting rod;

wherein the third axis is parallel to the fourth axis, and the fifth straight line is parallel to the plane in which the third axis and the fourth axis are located and perpendicular to the third axis.

14. The table cutting machine according to claim 13, wherein the transmission cam is provided with a projection which enables the top end of the transmission connecting rod to support the transmission cam.

15. The table cutting machine according to claim 14, wherein the transmission cam comprises two symmetrical semicircular portions and a straight line portion and a projecting portion for connecting the two semicircular portions, and the projecting portion is trapezoidal.

16. The table cutting machine according to claim 12, wherein the table cutting machine further comprises an electronic alarming device for sending an alarm to a user when the cooling liquid in the water tank rises beyond an alerting line.

17. The table cutting machine according to claim 16, wherein the electronic alarming device comprises a detecting device for detecting a position of the buoyancy ball and an alarming device for sending an alarm, wherein the detecting device comprises a contact switch and the alarming device is a LED light which is electrically connected the contact switch.

18. The table cutting machine according to claim 1, wherein the water level indicating device comprises a buoy and an indicating assembly, and the indicating assembly comprises a transparent indicating box fixed to one side of the water tank and having an accommodating space communicated with the water storing space in the interior of the water tank, and the buoy is accommodated in the accommodating space of the indicating box.

19. The table cutting machine according to claim 18, wherein the indicating box comprises:

a box body having an opening in a top end; and a box cover for closing the opening of the box body.

20. The table cutting machine according to claim 19, wherein the box body comprises an indicating portion for observation from the side of the water tank and a communicating portion passing through the wall of the water tank.

* * * * *